US007522102B2

(12) United States Patent
Shi

(10) Patent No.: US 7,522,102 B2
(45) Date of Patent: Apr. 21, 2009

(54) ANTENNA BEAM STEERING

(75) Inventor: Fong Shi, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 267 days.

(21) Appl. No.: 11/013,840

(22) Filed: Dec. 16, 2004

(65) Prior Publication Data

US 2006/0152410 A1 Jul. 13, 2006

(51) Int. Cl.
*H01Q 3/00* (2006.01)

(52) U.S. Cl. ..... 342/359; 342/354

(58) Field of Classification Search ..... 342/360, 342/368, 359, 56, 58, 52, 377, 354; 343/757, 343/763

See application file for complete search history.

(56) References Cited

U.S. PATENT DOCUMENTS

| | | | | |
|---|---|---|---|---|
| 3,599,495 | A | 8/1971 | Midlothian et al. | |
| 3,782,205 | A * | 1/1974 | Fletcher et al. | 73/497 |
| 4,725,843 | A * | 2/1988 | Suzuki et al. | 342/359 |
| 5,347,286 | A | 9/1994 | Babitch | |
| 5,809,457 | A | 9/1998 | Yee et al. | |
| 6,046,810 | A * | 4/2000 | Sanders et al. | 356/459 |
| 6,122,595 | A | 9/2000 | Varley et al. | |
| 6,421,622 | B1 * | 7/2002 | Horton et al. | 702/95 |
| 6,917,337 | B2 * | 7/2005 | Iida et al. | 343/702 |
| 2003/0095066 | A1 * | 5/2003 | Brogden | 342/372 |
| 2003/0130792 | A1 * | 7/2003 | Mori | 342/357.06 |

FOREIGN PATENT DOCUMENTS

| | | | |
|---|---|---|---|
| EP | 1 231 668 | | 12/2001 |
| GB | 2 320 368 | | 6/1998 |
| JP | 59060311 A | * | 4/1984 |
| JP | 09061510 | | 3/1997 |
| WO | WO 03/068589 | | 8/2003 |

OTHER PUBLICATIONS

, "Low Cost MMIC DBS Chip Sets for PHased Array Application, Wallace, Redd, and Furlow" (c) 1999 IEEE.

MILCOM 2001, "Commercial Ku-band SATCOM On-the Move using a Hybrid Tracking Scheme", Ioakimidis and Wexler, Oct. 28-30, 2001, IEEE Military communications Conference, New York, NY.

* cited by examiner

*Primary Examiner*—Thomas H Tarcza
*Assistant Examiner*—Fred H Mull
(74) *Attorney, Agent, or Firm*—Harness, Dickey & Pierce, P.L.C.

(57) ABSTRACT

An antenna steering system is provided that includes a plurality of gyro sensors fixedly located in close proximity to an antenna, for example a phased array antenna. The gyro sensors measure angular rotation of the antenna about an X-axis of the antenna, about a Y-axis of the antenna and about a Z-axis of the antenna. The gyro sensors communicate the angular rotation measurement data to a beam steering phase controller (BSPhC). The BSPhC utilizes the angular rotation measurements to determine a predicted amount of movement, i.e. a change in geolocation and/or orientation, of the antenna within a specified time period. Based on the predicted amount of antenna movement, the BSPhC adjusts a beam pointing angle of the antenna, i.e. steers the antenna, to compensate for the predicted amount of movement.

20 Claims, 5 Drawing Sheets

ANTENNA BEAM STEERING

FIELD OF INVENTION

The invention relates generally to controlling a pointing angle of an antenna, such as a phased array antenna. More particularly, the invention relates to a system and method for steering an antenna to maintain communication with a satellite or distant antenna when the geolocation and/or the orientation of the antenna rapidly changes.

BACKGROUND OF THE INVENTION

Many known antennas, such as phased array antennas (PAA's), use electronic beam steering control for pointing the antennas and communicating with satellites. Such antennas are often mounted on mobile platforms such as ships, trains, buses, and aircraft. Typically, current designs rely on centralized inertial navigation systems (INS) located in a central equipment bay of the mobile platform for positioning and controlling a beam pointing angle of the antenna. For example, antenna receiving units monitor the strength of an electromagnetic signal received from a target satellite and use power tracking to close the steering control loop. Antennas that transmit only typically operate utilizing open loop electronic beam steering to point the antenna based on computations by the INS.

Generally, the update rate for such antenna beam pointing controls is relatively slow, for example below 100 Hz. Due to the inherently long latency of such antenna control systems, communication links with the target satellite can be interrupted by unexpected movement of the mobile platform. Typically, if the mobile platform turns more than 20°/sec in any direction, the communication link will be at least temporarily interrupted. For example, large ships may have antenna equipment mounted on top of tall masts. Relative motions between the ship, the masts and rough sea presents problems for beam pointing using current beam steering systems. As another example, fast moving land vehicles often maneuver in trenched and bumpy terrain. Traversing such terrain could cause an antenna mounted to the top of the vehicle to move and change pointing directions more than 20° in several different directions within a very short period of time. In additions, extremely fast and nimble aircraft, such as the F-18, can make drastic course and orientation adjustments. Current antenna steering system struggle to adjust, i.e. correct, the beam pointing angle of an antenna to continuously maintain a satellite communication link during such drastic and quick movements of the antenna.

Furthermore, the expense and mass of a large, slow responding INS based system hinders its use on private or commercial mobile platforms, e.g. small aircraft, cars or trucks, in which passengers would benefit from a robust communication link for such things as Internet access.

Therefore, it is desirable to implement an antenna steering system and method that will continuously adjust the beam pointing angle of an antenna that is subject to rapid and relatively large movements within a large range of pointing angles. More particularly, such a preferred system and method would maintain an uninterrupted communication link with a satellite regardless of the frequency and magnitude of changes in the geolocation and/or orientation of the antenna.

BRIEF SUMMARY OF THE INVENTION

An antenna steering system in accordance with a preferred embodiment, includes a plurality of gyro sensors fixed in close proximity to an antenna. By being fixed located in close proximity to the antenna, the gyro sensors are oriented to match the antenna's orientation so that the gyro sensors are essentially at and continuously maintain the same position and orientation as the antenna. That is, as the antenna moves due to movement of a platform to which the antenna is mounted, e.g. an aircraft, the gyro sensors continuously maintain essentially the same geolocation and/or orientation as the antenna. The gyro sensors measure angular rotation of the antenna about an X-axis of the antenna, about a Y-axis of the antenna and about a Z-axis of the antenna.

The system additionally includes a beam steering processing unit (BSPU), preferably also in close proximity to the antenna. In a preferred implementation the gyro sensors are included in the BSPU. A beam steering phase controller (BSPhC) included in the BSPU receives positional change signals from the gyro sensors. The positional change signals include the angular rotation measurement data. The BSPhC utilizes the angular rotation measurements to determine a predicted amount of movement, i.e. a change in geolocation and/or orientation, of the antenna within a specified time period. For example, the BSPhC determines a predicted amount of antenna movement for each consecutive 1 ms period. Based on the predicted amount of antenna movement, the BSPhC adjusts a beam pointing angle of the antenna to compensate for the predicted amount of movement.

In another preferred embodiment of the present invention, a method for steering an antenna includes measuring a movement of the antenna away from a pointing direction, i.e. a change in geolocation and/or orientation. Such movement is measured by measuring angular rotation of the antenna utilizing one or more gyro sensors (or their equivalent) that are oriented to match the antenna orientation in 3-dimensional space. Generally three gyro sensors are used with each gyro sensor being arranged to measure angular rotation around one of three mutually orthogonal axes designated as the X-axis, the Y-axis gyro sensor and the Z-axis. In one implementation, the gyro sensors are included in a local navigation system fixedly located in close proximity to the antenna. Therefore, the gyro sensors maintain essentially the same geolocation and orientation as the antenna throughout any movement of the antenna.

In an exemplary embodiment, the method includes predicting the degree of angular rotation of an antenna away from a pointing direction, the angular velocity, and/or the angular acceleration along any one or more axes in a Cartesian 3-dimensional space, and computing control commands to adjust the beam pointing angle of the antenna based upon the predictions. Usually, such correction is accomplished using electronic beam steering commands fed to a controller for a phased array antenna. For example, a predicted amount of angular rotation of the antenna about the X-axis is determined at a specified time, e.g. 1 ms, based on the measurement of angular rotation about the X-axis. Additionally, a predicted amount of angular rotation of the antenna about the Y-axis at the specified time is determined based on the measurement of angular rotation about the Y-axis. And, a predicted amount of angular rotation of the antenna about the Z-axis at the specified time is determined based on the measurement of angular rotation about the Z-axis. The predicted amounts of angular rotations are converted to vector gradients in accordance with the following equations:

$$dx'=dx_\alpha+dx_\beta+dx_\gamma;$$

$$dy'=dy_\alpha+dy_\beta+dy_\gamma; \text{ and}$$

$$dz'=dz_\alpha+dz_\beta+dz_\gamma.$$

A beam pointing angle of the antenna is adjusted in accordance with the vector gradients.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention. Furthermore, the features, functions, and advantages of the present invention can be achieved independently in various embodiments of the present inventions or may be combined in yet other embodiments.

BRIEF DESCRIPTION OF THE DRAWINGS

The present invention will become more fully understood from the detailed description and accompanying drawings, wherein.

Corresponding reference numerals indicate corresponding parts throughout the several views of drawings.

DETAILED DESCRIPTION OF THE INVENTION

The following description of the preferred embodiments is merely exemplary in nature and is in no way intended to limit the invention, its application or uses. Additionally, the advantages provided by the preferred embodiments, as described below, are exemplary) in nature and not all preferred embodiments provide the same advantages or the same degree of advantages.

Figure 1:
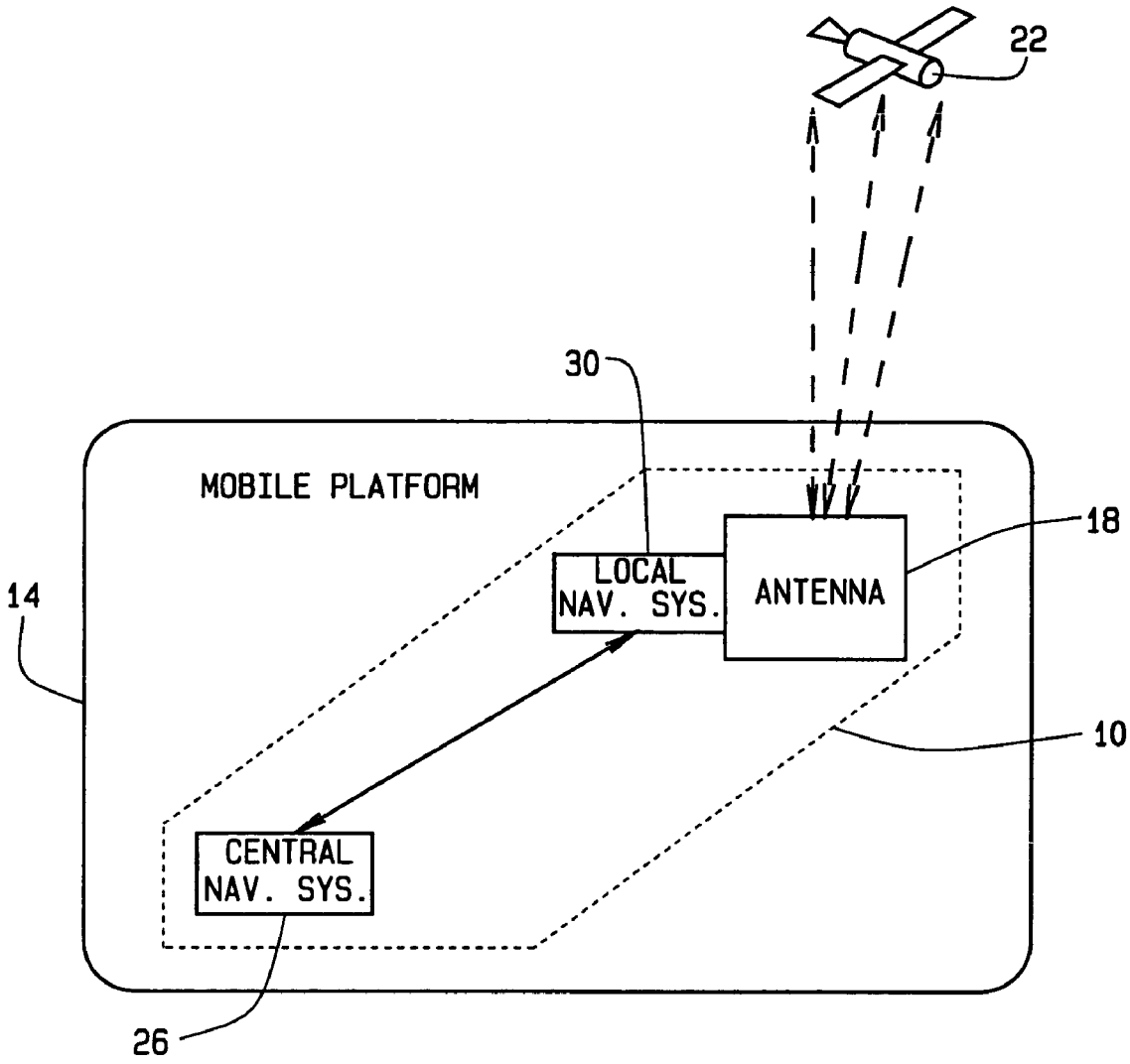
FIG. 1 is a block diagram of an antenna steering system in accordance with a preferred embodiment of the present invention.

FIG. 1 is a block diagram of an antenna steering system 10 in accordance with a preferred embodiment of the present invention. The antenna steering system 10 is implemented in a mobile platform 14, such as a train, bus, ship or aircraft, that desires consistent, uninterrupted communication between an antenna 18 mounted to an exterior of the mobile platform 14 and at least one satellite 22 or other distant or separate communication antenna. In a preferred form, the antenna 18 is a phased array antenna (PAA). The antenna steering system 10 includes a centralized navigation system 26 that is located remotely from the antenna 18, for example, within a central equipment bay (not shown) of the mobile platform 14. The antenna steering system additionally includes a localized navigation system 30 that communicates with the centralized navigation system 26. The localized navigation system 30 is fixedly located in close proximity to the antenna 18. That is, the local navigation system 30 is mounted, coupled or affixed to a portion of the mobile platform in a stationary manner. Therefore, the local navigation system 30 continuously maintains essentially the same geolocation and/or orientation of the antenna 18 as the mobile platform 14 moves, regardless of the frequency, magnitude and direction of the movements. In a preferred embodiment, the localized navigation system 30 is coupled to a portion of the antenna 18, for example an antenna platform (not shown) on which the antenna 18 is mounted.

Figure 2:
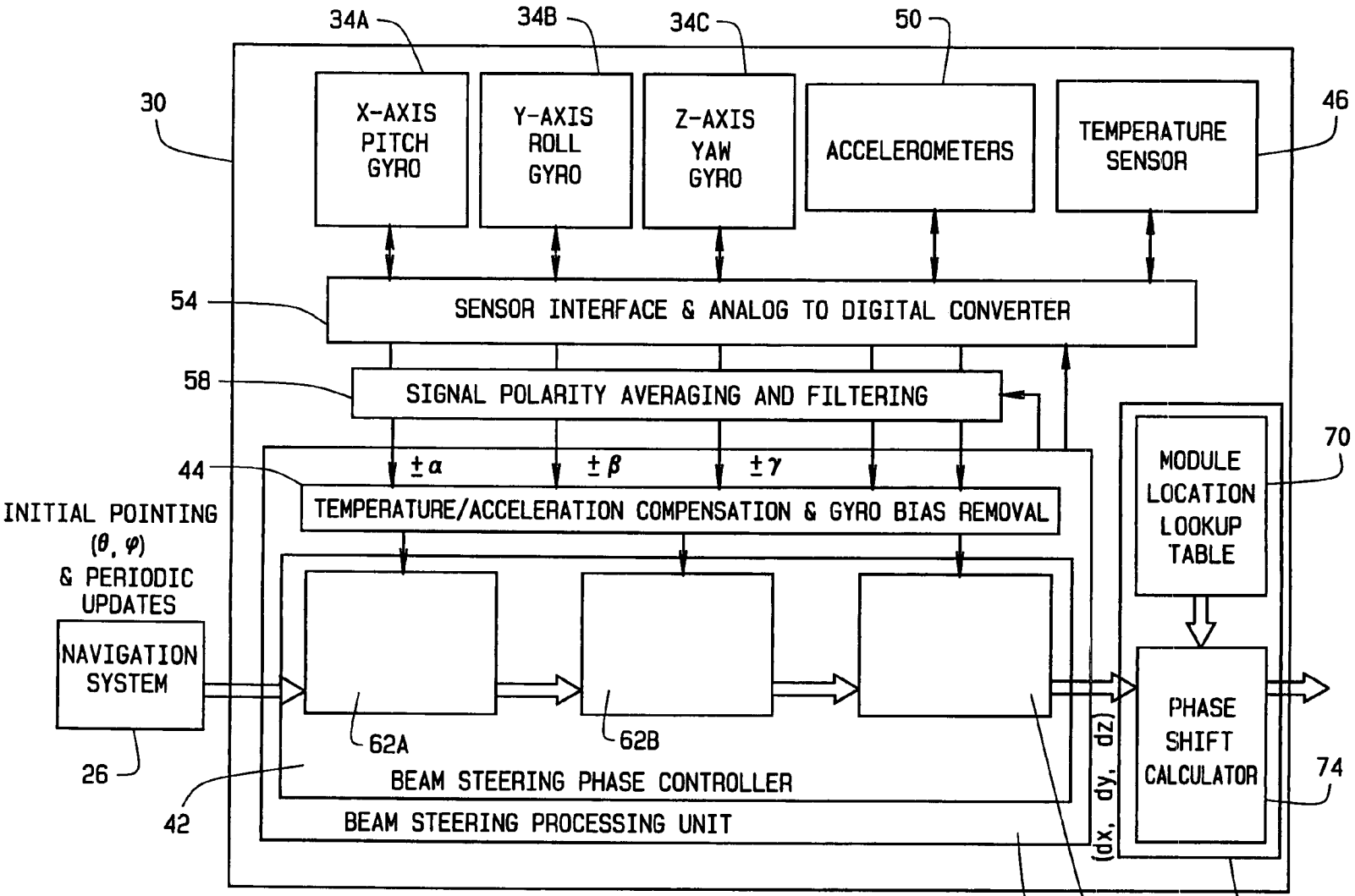
FIG. 2 is a block diagram of the localized navigation system shown in FIG. 1 in accordance with a preferred implementation of the present invention.
Figure 3:
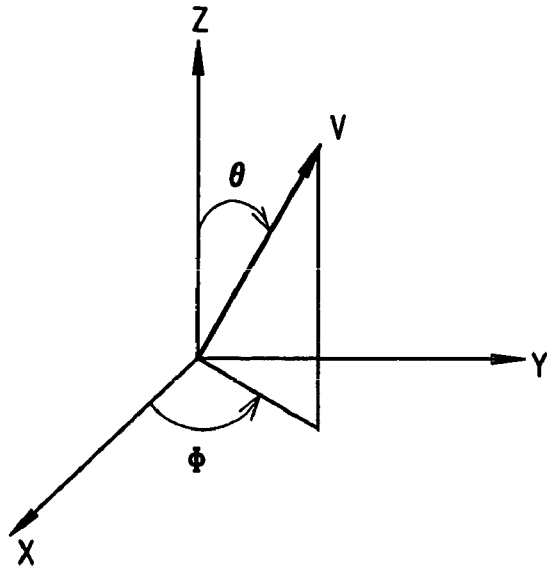
FIG. 3 is an illustration of a spherical coordinate system showing a vector representation of an initial pointing angle of the antenna shown in FIG. 1.

Referring to FIG. 2, a block diagram of the localized navigation system 30, in accordance with a preferred implementation of the present invention, is illustrated. The localized navigation system 30 includes a plurality of gyro sensors 34 that measure angular rotation of the antenna 18 about an X-axis, a Y-axis and a Z-axis of the antenna 18, as illustrated in FIG. 3. The gyro sensors 34 can be any gyro sensor suitable to measure angular rotation about an axis, for example, inexpensive over the counter commercial grade gyro sensors or expensive navigational grade gyro sensors. Although FIG. 2 illustrates the gyro sensors 34 in close proximity to the other components of the localized navigation system 30, described below, the gyro sensors 34 can be located separately from the other components. That is, the gyro sensors 34 can be housed separately from the other components of the localized navigation system 30. In which case, the gyro sensors 34 are fixedly located in close proximity to the antenna 18 while the other components are housed separately. More specifically, the gyro sensors 34 are mounted, coupled or affixed to a portion of the mobile platform such that the gyro sensors 34 continuously maintain essentially the same geolocation and/or orientation of the antenna 18 as the mobile platform 14 moves, regardless of the frequency, magnitude and direction of the movements.

The gyro sensors 34 continuously communicate positional change signals to a beam steering processing unit (BSPU) 38. The BSPU 38 is any suitable computer-based device including at least one electronic memory, i.e. data storage, device and capable of receiving data and executing various beam steering algorithms and commands in response thereto. The positional change signals provide measurement data indicating a change in the geolocation and/or the orientation of the antenna 18 as a result of movement of the mobile platform 14. Particularly, the positional change signals provide measurement data indicating an amount of angular rotation of the antenna 18 about the X, Y and/or Z axes. Utilizing the positional change signals, a beam steering phase controller (BSPhC) 42; included in the BSPU 38, determines a predicted amount of movement of the antenna 18 within a specified periodic time period, for example every 1 ms. Based on the predicted amount of movement, the BSPhC 42 outputs a signal used to essentially continuously adjust a beam pointing angle of the antenna 18 to compensate for the predicted amounts of movement. Therefore, the antenna 18 continuously maintains an uninterrupted communication link with the satellite 22. The BSPhC 42 can be any controller suitable for retrieving data from look up tables, performing calculations, executing the beam steering algorithms and providing steering control signals to an antenna steering mechanism (not shown). In a preferred implementation the BSPhC 42 electronically steers the beam pointing angle of the antenna 18 in spherical coordinates, but compensates, i.e. corrects, the beam pointing angle for movement of the antenna 18 according to pitch, roll and yaw motions along the X, Y and Z axes.

In a preferred embodiment the BSPU 38 includes a compensation circuit 44 that compensates the positional signals for temperature at the gyro sensors 34 and acceleration of the antenna 18. The compensation circuit 44 can be any circuit suitable to execute a compensation algorithm for adjusting variance in the angular rotation measurements caused by environmental temperature at the gyro sensors 34, for example a field programmable gate array (FPGA). The local navigation system 30 includes a temperature sensor 46 that measures the temperature of the environment to which the gyro sensors 34 are exposed. The BSPhC 42, i.e. the compensation circuit 44, receives temperature readings from the temperature sensor 46 and based on the temperature readings, the compensation circuit 44 compensates angular rotation measurements due to effects the environmental temperature may have on the gyro sensors 34.

Additionally, the compensation circuit 44 adjusts for variances in the angular rotation measurements caused by acceleration and/or deceleration of the mobile platform 14. The local navigation system 30 includes at least one acceleration sensor 50, e.g. an accelerometer(s), that measures acceleration and deceleration of the mobile platform 14. The accelerometer(s) 50 communicate(s) the acceleration/deceleration measurements to the BSPhC 42, i.e. the compensation circuit 44. The compensation circuit 44 utilizes the acceleration/deceleration measurements to compensate the angular rotations for variances caused by effects of the acceleration/deceleration on the gyro sensors 34. To compensate for temperature and acceleration, the compensation circuit 44 executes algorithms derived from specifications of the gyro sensors 34, the acceleration sensor 50, and the temperature sensor 46. Additionally, the compensation circuit 44 utilizes outputs from the accelerometer(s) 50 to remove any accumulated drift or bias of the gyro sensors 34.

Referring now to FIGS. 2 and 3, the centralized navigation system 26 determines a beam pointing angle for the antenna 18 that will establish an initial communication link with the satellite 22, or alternatively a distant, or separate, antenna. The initial beam pointing angle is communicated to the BSPhC 42 as initial spherical coordinates ($\theta$) and ($\phi$) for a vector representation (V) of the beam pointing angle. In a preferred embodiment, the centralized navigation system 26 is an inertial navigation system (INS). In another preferred embodiment the centralized navigation system 26 is a global position system (GPS). The BSPhC 42 utilizes the spherical coordinates $\theta$ and $\phi$ of the initial beam pointing angle to determine a phase vector gradient (dx) of the vector V along the X-axis, a phase vector gradient (dy) of the vector V along the Y-axis and a phase vector gradient (dz) of the vector V along the Z-axis. Based on the phase vector gradients dx, dy and dz, the BSPhC 42 outputs a signal utilized to steer the antenna to have the initial beam pointing angle. In a preferred implementation, the phase vector gradients dx, dy and dz are determined according the following equations:

$$dx=\sin\theta\cdot\cos\phi,$$

$$dy=\sin\theta\cdot\sin\phi;\text{ and}$$

$$dz=\cos\theta.$$

Figure 4:
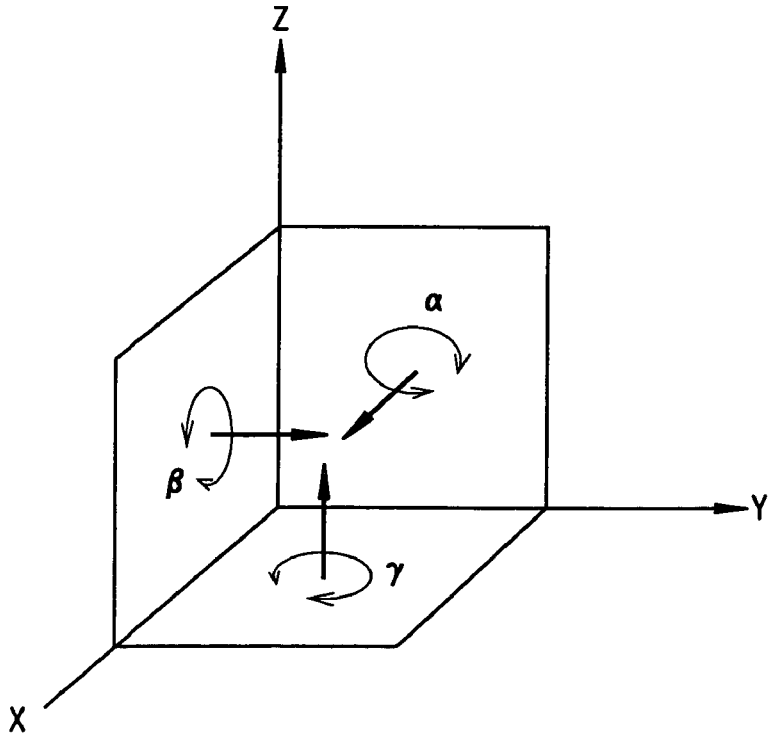
FIG. 4 is an illustration of a coordinate axis system on which the antenna shown in FIG. 1 is centered and the angular rotations of the antenna measured by the gyro sensors shown in FIG. 2.

Referring now to FIGS. 2 and 4, in a preferred form, the gyro sensors 34 include an X-axis sensor 34A for measuring an angular rotation ($\alpha$) of the antenna 18 about the X-axis, a Y-axis sensor 34B for measuring an angular rotation ($\beta$) of the antenna 18 about the Y-axis and a Z-axis sensor 34C for measuring an angular rotation ($\gamma$) of the antenna 18 about the Z-axis. The X, Y and Z sensors 34A, 34B and 34C measure the angular rotations $\alpha$, $\beta$ and $\gamma$ substantially in parallel and output the positional change signals. In a preferred embodiment, the X, Y and Z sensors 34A, 34B and 34C output analog positional change signals that are processed through a sensor interface and converter 54 to convert the analog positional change signals to digital positional change signals. The sensor interface and converter 54 can be any suitable analog to digital conversion device. The sensor interface and converter 54 also provides proper excitation and drive for the sensors 34. The converted positional change signals are then input to a signal polarity averaging and filtering circuit 58, e.g. a FPGA. Based on the positional change signals, the polarity averaging and filtering circuit 58 discards any transient noise and determines a rotational direction of movement of the antenna 18, i.e. clockwise (CW) or counter-clockwise (CCW). The polarity averaging and filtering circuit 58 assigns a polarity sign, e.g. plus or minus sign, to the digitized positional change signals.

Once the antenna 18 is pointed at the initial beam pointing angle, future beam pointing angles necessary to continuously maintain an uninterrupted communication link with the satellite 22 are determined completely by the local navigation system 30. Thus, the local navigation system 30 becomes an autonomous steering system for the antenna 18. However, the centralized navigation system 26 can provide periodic updates or a new target position when needed.

After the initial communication link is established, the X-axis gyro sensor 34A measures the angular rotation $\alpha$ of the antenna 18 about the X-axis a predetermined number of times (n) within a first time period (t). For example, the angular rotation $\alpha$ is measured ten times every 1 ms. The measurements of the angular rotation $\alpha$ are communicated from the X-axis sensor to the BSPhC 42. Likewise, the Y-axis and the Z-axis gyro sensors 34A and 34C respectively measure the angular rotations $\beta$ and $\gamma$ of the antenna about the Y and Z axes the predetermined number of times n within the first time period t. The measurements of the angular rotations $\beta$ and $\gamma$ are communicated from the Y-axis and the Z-axis sensors to the BSPhC 42. Thus, as the mobile platform 14 moves and changes geolocation and/or orientation, the X, Y and Z axis sensors 34A, 34B and 34C measure angular rotation of the antenna 18 about the respective axes due to the movement of the mobile platform 14.

Utilizing the measurements of $\alpha$, the BSPhC 42 determines an average amount of angular rotation ($\Delta V_\alpha$) of the antenna 18 about the X-axis for the first time period t. Utilizing the measurements of $\beta$, the BSPhC 42 determines an average amount of angular rotation ($\Delta V_\beta$) of the antenna 18 about the Y-axis for the first time period t. Utilizing the measurements of $\gamma$, the BSPhC 42 determines an average amount of angular rotation ($\Delta V_\gamma$) of the antenna 18 about the Z-axis for the first time period t. In a preferred form, the BSPhC 42 includes three electronic computing devices 62A, 62B and 62C that respectively determine the average amounts of angular rotation $\Delta V_\alpha$, $\Delta V_\beta$ and $\Delta V_\gamma$. The electronic computing devices 62A, 62B and 62C can be any suitable electronic computing devices capable of determining the average amounts of angular rotation $\Delta V_\alpha$, $\Delta V_\beta$ and $\Delta V_\gamma$, for example, three FPGAs. Alternatively, the electronic computing devices 62A, 62B and 62C can be a single FPGA containing all the digital circuitries needed to determining the average amounts of angular rotation $\Delta V_\alpha$, $\Delta V_\beta$ and $\Delta V_\gamma$. Accordingly, the first electronic computing device 62A would determine $\Delta V_\alpha$, the second electronic computing device 62B would determine $\Delta V_\beta$ and the third electronic computing device 62C would determine $\Delta V_\gamma$. In a preferred embodiment, the average amounts of angular rotation $\Delta V_\alpha$, $\Delta V_\beta$ and $\Delta V_\gamma$ are determined in accordance with the following equations:

$\Delta V_\alpha=[(V_{\alpha 1}+V_{\alpha 2}+\ldots V_{\alpha n})/n]-V_{\alpha null}$, wherein $V_{\alpha null}$ is the value of the vector V along the X-axis at the initial beam pointing angle;

$\Delta V_\beta=[(V_{\beta 1}+V_{\beta 2}+\ldots V_{\beta n})/n]-V_{\beta null}$, wherein $V_{\beta null}$ is the value of the vector V along the Y-axis at the initial beam pointing angle; and $\Delta V_\gamma=[(V_{\gamma 1}+V_{\gamma 2}+\ldots V_{\gamma n})/n]-V_{\gamma null}$, wherein $V_{\gamma null}$ is the value of the vector V along the Z-axis at the initial beam pointing angle.

The BSPhC 42, e.g. the electronic computing device 62A, then determines a predicted amount of angular rotation ($\alpha'$) of the antenna 18 about the X-axis for a second time period (T), based on the average amount of angular rotation $\Delta V_\alpha$. The second time period T is function of the first time period t. In like fashion, the BSPhC 42, e.g. the electronic computing devices 62B and 62C, determines a predicted amount of angular rotation $\beta'$ and a predicted amount of angular rotation $\gamma'$ of the antenna 18 about the Y and Z axes for the time period T based on the average amounts of angular rotations $\Delta V_\beta$ and $\Delta V_\gamma$. In a preferred embodiment, the predicted amounts of angular rotations $\alpha'$, $\beta'$ and $\gamma'$ are determined in accordance with the following equations:

$$\alpha'=\Delta V_\alpha * T;$$

$$\beta'=\Delta V_\beta * T; \text{ and}$$

$$\gamma'=\Delta V_\gamma * T.$$

Figure 5A:
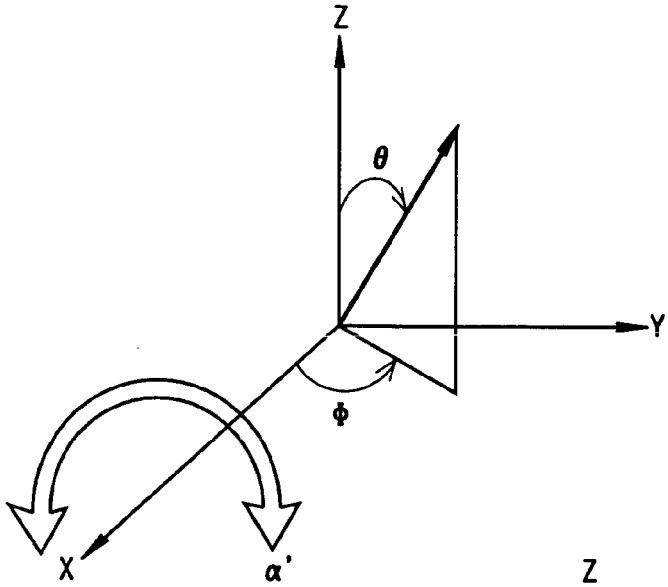
FIG. 5A is an illustration of the spherical coordinate system shown in FIG. 3 illustrating the vector representation of the initial pointing angle of the antenna with respect to a predicted angular rotation about the X-axis from which predicted vector gradients are determined.

As described above, the signal polarity averaging and filtering circuit determines the rotational direction positional change signals generated by the gyro sensors 34. Referring to FIG. 5A, based on the rotational direction of the predicted angular rotation $\alpha'$, the BSPhC 42, e.g. the electronic computing device 62A, converts the predicted angular rotation $\alpha'$ to radians ($dx_\alpha$, $dy_\alpha$ and $dz_\alpha$). The radian conversions $dx_\alpha$, $dy_\alpha$ and $dz_\alpha$ equal a predicted amount of movement of the antenna along the X, Y and Z axes at the second time T, as a result of the angular rotation $\alpha$. In a preferred embodiment, the BSPhC 42 converts the predicted angular rotation $\alpha'$ to radians $dx_\alpha$, $dy_\alpha$ and $dz_\alpha$ in accordance with the following equations:

if the direction of the predicted angular rotation $\alpha'$ is counter-clockwise, then $$dx_\alpha=\sin(\theta+\alpha')\cdot\cos\phi=(\sin\theta+\alpha'\cos\theta)\cdot\cos\phi$$

$$dy_\alpha=\sin(\theta+\alpha')\cdot\sin\phi=(\sin\theta+\alpha'\cos\theta)\cdot\sin\phi$$

$$dz_\alpha=\cos(\theta+\alpha')=\cos\theta-\alpha'\sin\theta; \text{ and}$$

if the direction of the predicted angular rotation $\alpha'$ is clockwise, then $$dx_\alpha=\sin(\theta+\alpha')\cdot\cos\phi=(\sin\theta-\alpha'\cos\theta)\cdot\cos\phi$$

$$dy_\alpha=\sin(\theta+\alpha')\cdot\sin\phi=(\sin\theta-\alpha'\cos\theta)\cdot\sin\phi$$

$$dz_\alpha=\cos(\theta+\alpha')=\cos\theta+\alpha'\sin\theta,$$

wherein, $\theta$ and $\phi$ are the spherical coordinates of the vector V at the present beam pointing angle, for example the spherical coordinates of V at the initial beam pointing angle.

Figure 5B:
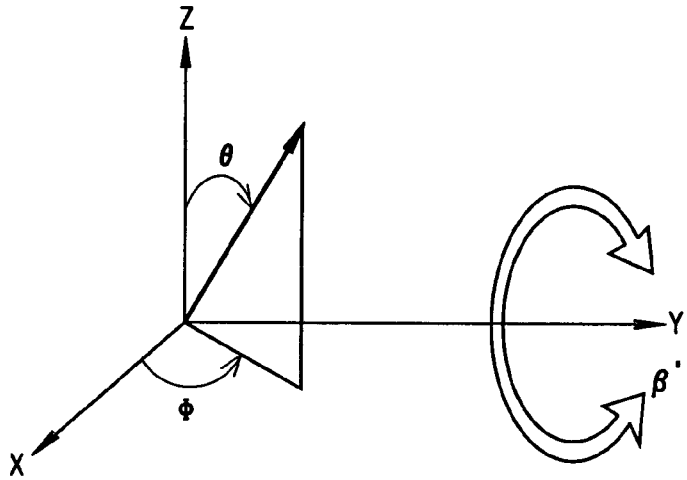
FIG. 5B is an illustration of the spherical coordinate system shown in FIG. 3 illustrating the vector representation of the initial pointing angle of the antenna with respect to a predicted angular rotation about the Y-axis from which predicted vector gradients are determined.

Referring now to FIG. 5B, accordingly, based on the rotational direction of the predicted angular rotation $\beta'$, the BSPhC 42, e.g. the electronic computing device 62B, converts the predicted angular rotation $\beta'$ to radians ($dx_\beta$, $dy_\beta$ and $dz_\beta$). The radian conversions $dx_\beta$, $dy_\beta$ and $dz_\beta$ equal a predicted amount of movement of the antenna along the X, Y and Z axes at the second time T, as a result the angular rotation $\beta$. In a preferred embodiment, the BSPhC 42 converts the predicted angular rotation $\beta'$ to radians $dx_\beta$, $dy_\beta$ and $dz_\beta$ in accordance with the following equations:

if the direction of the predicted angular rotation $\beta'$ is counter-clockwise, then $$dx_\beta=\sin(\theta+\beta')\cdot\cos\phi=(\sin\theta+\beta'\cos\theta)\cdot\cos\phi$$

$$dy_\beta=\sin(\theta+\beta')\cdot\sin\phi=(\sin\theta+\beta'\cos\theta)\cdot\sin\phi$$

$$dz_\beta=\cos(\theta+\beta')=\cos\theta-\beta'\sin\theta; \text{ and}$$

if the direction of the predicted angular rotation $\beta'$ is clockwise, then $$dx_\beta=\sin(\theta+\beta')\cdot\cos\phi=(\sin\theta-\beta'\cos\theta)\cdot\cos\phi$$

$$dy_\beta=\sin(\theta+\beta')\cdot\sin\phi=(\sin\theta-\beta'\cos\theta)\cdot\sin\phi$$

$$dz_\gamma=\cos(\theta-\beta')=\cos\theta+\beta'\sin\theta,$$

wherein, $\theta$ and $\phi$ are the spherical coordinates of the vector V at the present beam pointing angle, for example the spherical coordinates of V at the initial beam pointing angle.

Figure 5C:
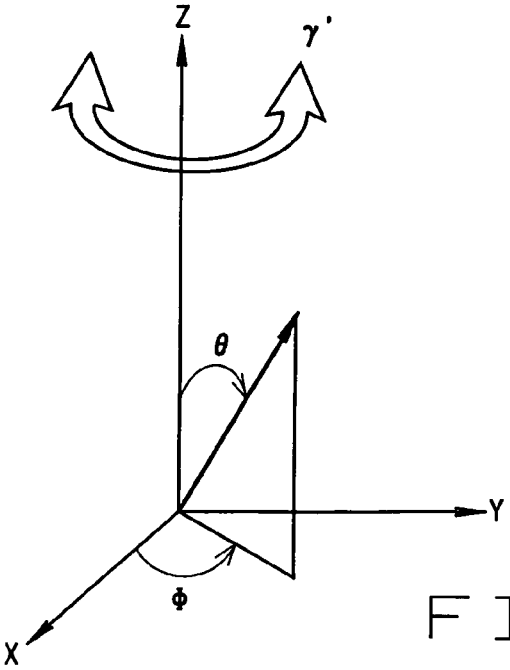
FIG. 5C is an illustration of the spherical coordinate system shown in FIG. 3 illustrating the vector representation of the initial pointing angle of the antenna with respect to a predicted angular rotation about the Z-axis from which predicted vector gradients are determined.

Referring to FIG. 5C, furthermore, based on the rotational direction of the predicted angular rotation $\gamma'$, the BSPhC 42, e.g. the electronic computing device 62C, converts the predicted angular rotation $\gamma'$ to radians ($dx_\gamma$, $dy_\gamma$ and $dz_\gamma$). The radian conversions $dx_\gamma$, $dy_\gamma$ and $dz_\gamma$ equal a predicted amount of movement of the antenna along the X, Y and Z axes at the second time T, as a result the angular rotation $\gamma$. In a preferred embodiment, the BSPhC 42 converts the predicted angular rotation $\gamma'$ to radians $dx_\gamma$, $dy_\gamma$ and $dz_\gamma$ in accordance with the following equations:

if the direction of the predicted angular rotation $\gamma'$ is counter-clockwise, then $$dx_\gamma=\sin\theta\cdot\cos(\phi+\gamma')=\sin\theta\cdot(\cos\phi-\gamma'\sin\phi)$$

$$dy_\gamma=\sin\theta\cdot\sin(\phi+\gamma')=\sin\theta\cdot(\sin\phi+\gamma'\cos\phi)$$

$$dz_\gamma=\cos\theta; \text{ and}$$

if the direction of the predicted angular rotation $\gamma'$ is counter-clockwise, then $$dx_\gamma=\sin\theta\cdot\cos(\phi+\gamma')=\sin\theta\cdot(\cos\phi+\gamma'\sin\phi)$$

$$dy_\gamma=\sin\theta\cdot\sin(\phi+\gamma')=\sin\theta\cdot(\sin\phi-\gamma'\cos\phi)$$

$$dz_\gamma=\cos\theta,$$

wherein, $\theta$ and $\phi$ are the spherical coordinates of the vector V at the present beam pointing angle, for example the spherical coordinates of V at the initial beam pointing angle.

Referring now to FIGS. 5A, 5B and 5C, after converting the predicted angular rotations $\alpha'$, $\beta'$ and $\gamma'$ to radians, the BSPhC 42, e.g. the electronic computing device 62A, determines a predicted vector gradient (dx') for the beam pointing vector V along the X-axis. Likewise, the BSPhC 42, e.g. the electronic computing device 62B, determines a predicted vector gradient (dy') for the beam pointing vector V along the Y-axis.

Additionally, the BSPhC 42, e.g. the electronic computing device 62C, determines a predicted vector gradient (dz') for the beam pointing vector V along the Z axis. In a preferred implementation, the predicted vector gradients dx', dy' and dz', are determined in a sequence flow in accordance with the following equations:

$$dx'=dx_\alpha+dx_\beta+dx_\gamma;$$

$$dy'=dy_\alpha+dy_\beta+dy_\gamma; \text{ and}$$

$$dz'=dz_\alpha+dz_\beta+dz_\gamma.$$

The BSPhC 42 then outputs a signal utilized to steer the antenna 18 to have a new beam pointing angle defined by the predicted phase vector gradients dx', dy' and dz'. Therefore, the beam pointing angle is adjusted to compensate for the predicted amount of movement of the antenna to thereby maintain the communication link with the satellite 22, or alternatively a distant antenna. Furthermore, the process of measuring the angular rotations of the antenna 18 about the X, Y and Z axes and compensating the beam pointing angle in response thereto is continuously repeated for each subsequent first time period t so that an essentially continuous communication link with the satellite is maintained.

It should be understood that although the present invention, as described above, is applicable for use with various types of antennas, it is particularly useful for phased array antennas (PAAs). It should further be understood that a PAA includes a plurality of antenna array modules that are each independently steered, i.e. pointed, to have their own beam pointing angles. Therefore, the beam pointing angle of each antenna array module of a PAA would be essentially continuously adjusted based on the predicted phase vector gradients dx', dy' and dz'. Accordingly, in a preferred embodiment, the localized navigation system 30 includes an array module phase shift device 66 that includes a module location lookup table 70 and a phase shift calculator 74. In an exemplary embodiment, the module lookup table 70 and the phase shift calculator 74 are FPGAs. The module lookup table 70 stores physical locations, i.e. distances in wavelength, from each array module to a phase center of the antenna 18. The phase shift calculator 74 utilizes the signal output from the BSPhC 42 and the locations stored in the module lookup table 70 to compute a phase delay for each array module based on the module's physical location.

Figure 6:
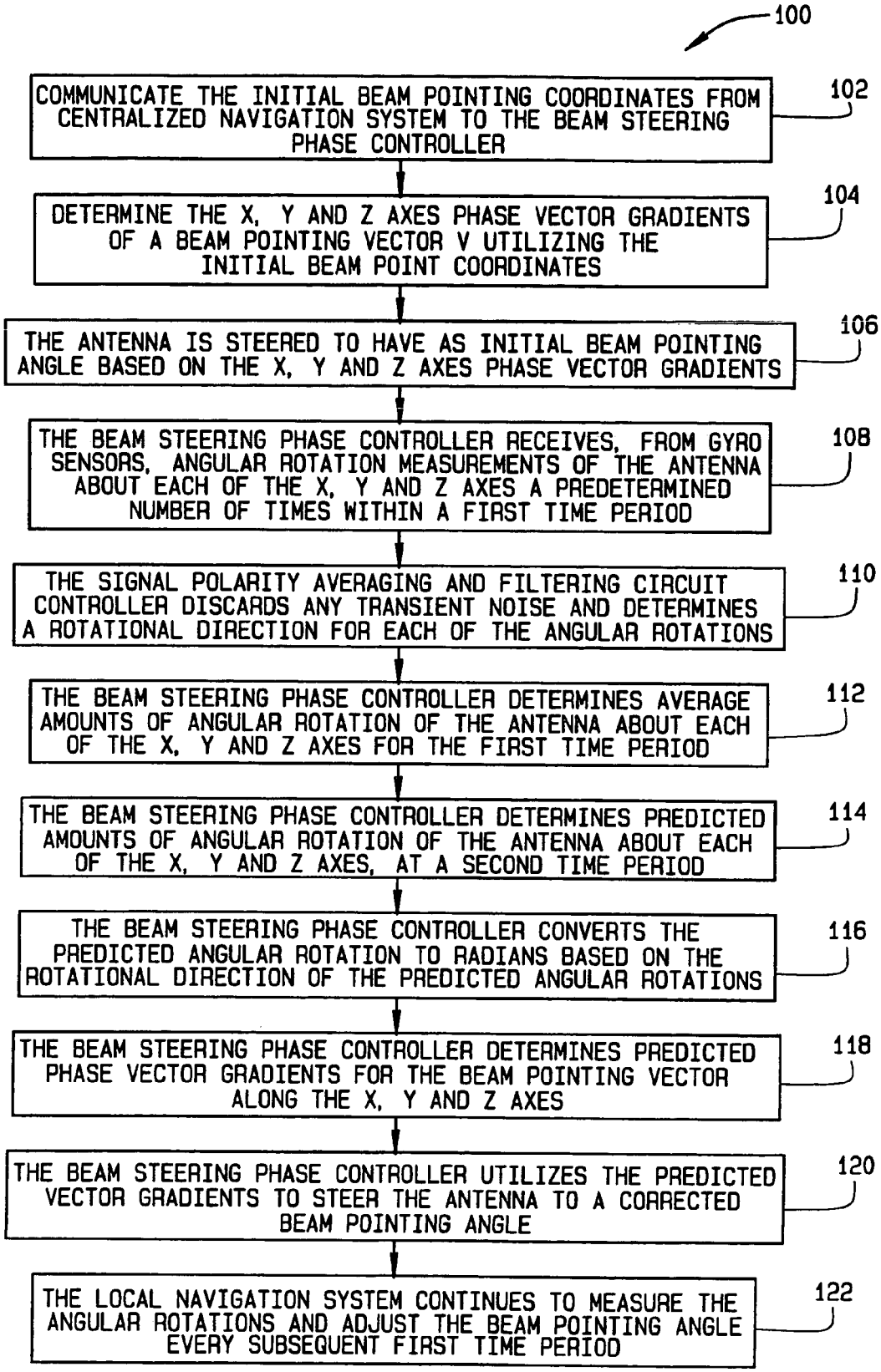
FIG. 6 is a flow chart illustrating a method for steering an antenna, in accordance with a preferred embodiment of the present invention.

FIG. 6 is a flow chart 100 illustrating the method of operation of the antenna steering system 10, in accordance with a preferred embodiment of the present invention. To obtain an initial pointing angle of the antenna 18, the centralized navigation system 26 communicates the initial beam pointing coordinates θ and ϕ to the BSPhC 42 of the local navigation system 30, as indicated at 102. The initial beam point coordinates θ and ϕ are then utilized by the BSPhC 42 to determine the X, Y and Z axes phase vector gradients of a beam pointing vector V, as indicated at 104. The BSPhC 42 then outputs a signal utilized to point the antenna 18 to have an initial beam pointing angle based on the X, Y and Z axes phase vector gradients, as indicated at 106. Or, if the antenna 18 is a PAA, the signal from the BSPhC 42 is processed by the array module phase shift device 66 to point each of the antenna array modules to have an initial beam pointing angle based on the X, Y and Z axes phase vector gradients.

Next, the BSPhC 42 receives from the gyro sensors 34 angular rotation measurements α, β and γ of the antenna 18 about each of the X, Y and Z axes the predetermined number of times n within the first time period (t), as indicated at 108. In a preferred embodiment, once the amounts of angular rotations α, β and γ are determined, the signal polarity averaging and filtering circuit 58 discards any transient noise and determines a rotational direction for each of the angular rotations α, β and γ, as indicated at 110. Based on the angular rotation measurements α, β and γ, the BSPhC 42 determines the average amounts of angular rotation $\Delta V_\alpha$, $\Delta V_\beta$ and $\Delta V_\gamma$ of the antenna 18 about each of the X, Y and Z axes for the first time period t, as indicated at 112. The BSPhC 42 then determines the predicted amounts of angular rotation α', β' and γ' of the antenna 18 about each of the X, Y and Z axes, at the second time period T, based on the average amounts of angular rotation $\Delta V_\alpha$, $\Delta V_\beta$ and $\Delta V_\gamma$, as indicated at 114.

Next, the BSPhC 42 converts the predicted angular rotations α', β' and γ' to radians based on the rotational direction of the predicted angular rotations α', β' and γ', as indicated at 116. Based on the radian conversions, the BSPhC 42 determines the predicted vector gradients dx', dy' and dz' for the beam pointing vector along the X, Y and Z axes, as indicated at 118. The predicted vector gradients dx', dy' and dz' indicate a predicted amount of change in at least one of the geolocation and the orientation of the antenna 18 along the X, Y and Z axes at the second time T. The BSPhC 42 utilizes the predicted vector gradients dx', dy' and dz' to output a signal used to steer the antenna 18 to a corrected beam pointing angle to thereby maintain the communication link with the satellite 22, as indicated at 120. Or, if the antenna 18 is a PAA, the signal output from the BSPhC 42 is passed through the array module phase shift device 66 to output a modulated signal used to point each of the antenna array modules. Thus, the beam pointing angles of each array module is independently corrected based on the predicted vector gradients dx', dy' and dz'. It should be understood that the independent corrected beam pointing angles of each antenna array module cumulatively comprise a single beam pointing angle for PAA.

It will be appreciated that the first time period t, if no one or more of the average amounts of angular rotation $\Delta V_\alpha$, $\Delta V_\beta$ and $\Delta V_\gamma$ are net zero, i.e. there is no net motion of the antenna 18, the associated compensation calculations are skipped for that specific first time period t.

The local navigation system 30 continues to measure the angular rotations α, β and γ and adjust the beam pointing angle every subsequent first time period t, as indicated at 122. Therefore, the local navigation system 30 autonomously steers, either electronically or mechanically, the antenna 18 to continuously maintain an effectively uninterrupted communication signal with the satellite 22, regardless of the frequency and magnitude of movements made by the mobile platform.

While the invention has been described in terms of various specific embodiments, those skilled in the art will recognize that the invention can be practiced with modification within the spirit and scope of the claims.

What is claimed is:

1. A method for steering an antenna being carried on a mobile platform, where the antenna is able to move independently of movement of the mobile platform, and where the mobile platform includes a central navigation system, said method for steering an antenna comprising:

supporting a localized navigation system adjacent the antenna and apart from said central navigation system, such that said localized navigation system moves in accordance with movement of said antenna and independently of motion of said mobile platform;

using the localized navigation system to generate a plurality of positional change signals that indicate a change in at least one of a geolocation and an orientation of an antenna, independent of motion of the mobile platform, over a first time period, the positional change signals being generated by a plurality of gyro sensors of the localized navigation system such that the gyro sensors maintain the same geolocation and orientation as the antenna, wherein generating the positional change signals includes;

measuring a change in angular rotation of the antenna about each of an X-axis, a Y-axis and a Z-axis a predetermined number of times within the first time period, utilizing the gyro sensors;

predicting an amount of change in at least one of the geolocation and the orientation of the antenna over a second time period utilizing the predetermined number of measured changes in angular rotation of the antenna within the first time period; and correcting a beam pointing angle of the antenna, based on the predicted amount of change in the at least one of the geolocation and the orientation of the antenna, to compensate for the predicted change in the at least one of the geolocation and the orientation of the antenna.

2. The method of claim 1, wherein correcting the beam pointing angle comprises discarding transient noise for each of the angular rotation measurements.

3. The method of claim 1, wherein predicting an amount of change comprises:

determining a rotational direction for each of the angular rotations;

determining an average amount of angular rotation of the antenna about each of the X, Y and Z axes for the first time period;

determining a predicted amount of angular rotation of the antenna about each of the X, Y and Z axes, at the second time, based on the average amounts of angular rotation; and converting the predicted angular rotations about each of the X, Y and Z axes to radians based on the rotational direction of the angular rotations.

4. The method of claim 3, wherein correcting the beam pointing angle further comprises:

determining, based on the radian conversions, a predicted vector gradient for the beam pointing vector along the X-axis, a predicted vector gradient for the beam pointing vector along the Y-axis, and a predicted vector gradient for the beam pointing vector along the Z-axis, to determine a predicted amount of change in at least one of the geolocation and the orientation of the antenna along the X, Y and Z axes at the second time; and steering the antenna based on the predicted vector gradients to correct the beam pointing angle of the antenna.

5. The method of claim 1, wherein generating the positional change signals further comprises determining initial spherical coordinates for an initial beam pointing angle of the antenna.

6. An antenna steering system for use with an antenna supported on a mobile platform, where the antenna moves independently of motion of the mobile platform, and where the mobile platform includes a central navigation system, the antenna steering system comprising:

a localized navigation system located apart from said central navigation system, and where said localized navigation system includes a plurality of gyro sensors located in close proximity to the antenna such that the gyro sensors continuously maintain essentially the same position as the antenna, independently of motion of the mobile platform, the gyro sensors configured to measure angular rotation of the antenna about an X-axis of the antenna, a Y-axis of the antenna and a Z-axis of the antenna for a minor time period, wherein the gyro sensors comprises:

a first gyro sensor configured to measure changes in angular rotation of the antenna about the X-axis a predetermined number of times within the specified minor time period;

a second gyro sensor configured to measure changes in angular rotation of the antenna about the Y-axis the predetermined number of times within the minor time period; and a third gyro sensor configured to measure changes in angular rotation of the antenna about the Z-axis of the antenna the predetermined number of times within the minor time period; and a beam steering processing unit (BSPU) responsive to the localized navigation subsystem and configured to utilize the angular rotation measurements for the minor time period to determine a predicted amount of movement of the antenna within a specified major time period and to adjust a beam pointing angle of the antenna to compensate for the predicted amount of movement of the antenna, independent of movement of the mobile platform.

7. The system of claim 6, wherein the BSPU includes a beam steering phase controller (BSPhC) configured to receive the angular rotation measurements from the first, second and third gyro sensors and determine an average amount of angular rotation about the X-axis, an average amount of angular rotation about the Y-axis and an average amount of angular rotation about the Z-axis for the minor time period.

8. The system of claim 7, wherein the BSPhC is further configured to:

determine a rotational direction for each of the average angular rotations about the X, Y and Z axes;

utilize the average angular rotations about X, Y and Z axes to determine a predicted amount of angular rotation about the X-axis, a predicted amount of angular rotation about the Y-axis and a predicted amount of angular rotation about the Z-axis at the major time period, the major time period being a function of the minor time period; and determine a predicted amount of movement of the antenna along the X, Y and Z axes within the major time period by converting the predicted angular rotations about the X, Y and Z axes to radians based on the direction of each angular rotation.

9. The system of claim 8, wherein the system further includes a temperature sensor and the BSPhC is further configured to utilize the temperature sensor to compensate the predicted angular rotations about the X, Y and Z axes for effects of temperature on the gyro sensors, wherein the temperature compensations are performed prior to converting the predicted angular rotations to radians.

10. The system of claim 8, wherein the BSPhC is further configured to:

utilize the radian conversions of the predicted angular rotations about the X, Y and Z axes to determine a predicted vector gradient along the X-axis of a vector representation of the beam pointing angle, a predicted vector gradient along the Y-axis of the vector representation, and a predicted vector gradient along the Z-axis of the vector representation; and steer the antenna based on the predicted vector gradients to compensate for the predicted amount of movement of the antenna.

11. A method for steering a phased array antenna mounted on a mobile platform, where the mobile platform includes a central navigation system, said method comprising:

supporting said phased array antenna on said mobile platform;

mounting a localized navigation subsystem adjacent to said phased array antenna, and apart from said central navigation system, so that said localized navigation subsystem moves in accordance with motion of said antenna, independently of motion of said mobile platform;

using said localized navigation subsystem to measure changes in angular rotation ($\alpha$) of the phased array antenna (PAA) about an X-axis for a first time period (t), changes in angular rotation ($\beta$) of the PAA about a Y-axis for the first time period (t) and changes in angular rotation ($\gamma$) of the PAA about a Z-axis for the first time period (t), wherein measuring the angular rotations $\alpha$, $\beta$ and $\gamma$ comprises measuring the changes in angular rotations $\alpha$, $\beta$ and $\gamma$ of the PAA a predetermined number of times (n) within the first time period (t);

determining a predicted amount of angular rotation $\alpha'$ of the PAA about the X-axis for a second time period (T), a predicted amount of angular rotation $\beta'$ of the PAA about the Y-axis for the second time period T and a predicted amount of angular rotation $\gamma'$ of the PAA about the Z-axis for the second time period T, utilizing the measured angular rotations $\alpha$, $\beta$ and $\gamma$;

compensating for thermal affects on said measured angular rotations $\alpha$, $\beta$ and $\gamma$; and adjusting a beam pointing angle of the PAA, based on the predicted angular rotations $\alpha'$,$\beta'$ and $\gamma'$, to compensate for a predicted change in at least one of the geolocation and the orientation of the PAA.

12. The method of claim 11, further comprising:

communicating initial spherical coordinates ($\theta$and $\phi$) from a central navigation system located remotely from the PAA, to a beam steering processing unit (BSPU) included in a local navigation system fixedly located in close proximity to the PAA such that the local navigation system maintains a same geolocation and orientation as the PAA; and steering the phased array antenna to have an initial beam pointing angle based on the initial spherical coordinates $\theta$ and $\phi$.

13. The method of claim 11, wherein determining the predicted amount of angular rotations $\alpha'$, $\beta'$ and $\gamma'$ comprises:

determining a rotational direction for each of the angular rotations $\alpha$, $\beta$ and $\gamma$;

determining an average amount of angular rotation ($\Delta V_\alpha$) of the PAA about the X-axis for the first time period t, wherein $\Delta V_{\alpha\alpha}=[(V_{\alpha 1}+V_{\alpha 2}+\ .\ .\ .\ V_{\alpha n)/n]-V\alpha null}$, and determining the predicted amount of angular rotation $\alpha'$, wherein $\alpha'=\Delta V_\alpha{}^*T$, and the second time period T is a function of t;

determining an average amount of angular rotation ($\Delta V_\beta$) of the PAA about the Y-axis for the first time period t, wherein $\Delta V_\beta=[(V_{\beta 1}+V_{\beta 2}+\ .\ .\ .\ V_{\beta n})/n]-V_{\beta null}$, and determining the predicted amount of angular rotation $\beta'$, wherein $\beta'=\Delta V_\beta{}^*T$; and determining an average amount of angular rotation ($\Delta V_\gamma$) of the PAA about the Z-axis for the first time period t, wherein $\Delta V_\gamma=[(V_{\gamma 1}+V_{\gamma 2}+\ .\ .\ .V_{\gamma n})/n]-V_{\gamma null}$, and determining the predicted amount of angular rotation $\gamma'$, utilizing the BSPU wherein $\gamma'=\Delta V_\gamma{}^*T$.

14. The method of claim 13, wherein adjusting the beam pointing angle comprises:

converting the predicted angular rotation $\alpha'$ to radians ($dx_\alpha$, $dy_\alpha$ and $dz_\alpha$), to determine a predicted amount of change in at least one of the geolocation and the orientation of the PAA along the X, Y and Z axes at the second time period T, as a result the angular rotation $\alpha$, wherein if the direction of the predicted angular rotation $\alpha'$ is counter-clockwise, then $$dx_\alpha=\sin(\theta+\alpha')\cdot\cos\phi=(\sin\theta+\alpha'\cos\theta)\cdot\cos\phi$$

$$dy_\alpha=\sin(\theta+\alpha')\cdot\sin\theta=(\sin\theta+\alpha'\cos\theta)\cdot\sin\phi$$

$$dz_\alpha=\cos(\theta+\alpha')=\cos\theta-\alpha'\sin\theta;\text{ and}$$

if the direction of the predicted angular rotation $\alpha'$ is clockwise, then $$dx_\alpha=\sin(\theta-\alpha')\cdot\cos\phi=(\sin\theta-\alpha'\cos\theta)\cdot\cos\phi$$

$$dy_\alpha=\sin(\theta-\alpha')\cdot\sin\phi=(\sin\theta-\alpha'\cos\theta)\cdot\sin\phi$$

$$dz_\alpha=\cos(\theta-\alpha')=\cos\theta+\alpha'\sin\theta;$$

converting the predicted angu0lar rotation ,$\beta'$ to radians ($dx_\alpha$, $dy_{60}$ , and $dz_\alpha$), utilizing the BSPU, to determine a predicted amount of change in at least one of the geolocation and the orientation of the PAA along the X, Y and Z axes at the second time period T, as a result the angular rotation $\beta$, wherein if the direction of the predicted angular rotation $\beta'$ is counter-clockwise, then $$dx_\beta=\sin(\theta+\beta')\cdot\cos\phi=(\sin\theta+\beta'\cos\theta)\cdot\cos\phi$$

$$dy_\beta=\sin(\theta+\beta')\cdot\sin\phi=(\sin\theta+\beta'\cos\theta)\cdot\sin\phi$$

$$dz_\beta=\cos(\theta+\beta')=\cos\theta-\beta'\sin\theta;\text{ and}$$

if the direction of the predicted, angular rotation $\beta'$ is clockwise, then $$dx_\beta=\sin(\theta-\beta')\cdot\cos\phi=(\sin\theta-\beta'\cos\theta)\cdot\cos\phi$$

$$dy_\beta=\sin(\theta-\beta')\cdot\sin\phi=(\sin\theta-\beta'\cos\theta)\cdot\sin\phi$$

$$dz_\beta=\cos(\theta-\beta')=\cos\theta+\beta'\sin\theta;\text{ and}$$

converting the predicted angular rotation $\gamma'$ to radians ($dx_\gamma$, $dy_{\gamma and\ dz\gamma}$), utilizing the BSPU, to determine a predicted amount of change in at least one of the geolocation and the orientation of the PM along the X, Y and Z axes at the second time period T, as a result the angular rotation $\gamma$, wherein if the direction of the predicted angular rotation $\gamma'$ is counter-clockwise, then $$dx_\gamma=\sin\theta\cdot\cos(\phi+\gamma')=\sin\theta\cdot(\cos\phi-\gamma'\sin\phi$$

$$dy_\gamma=\sin\theta\cdot\sin(\phi+\gamma')=\sin\theta\cdot(\sin\phi+\gamma'\cos\phi)$$

$$dz_\gamma=\cos\theta;\text{ and}$$

if the direction of the predicted angular rotation $\gamma'$ is counter-clockwise, then $$dx_\gamma=\sin\theta\cdot\cos(\phi+\gamma')=\sin\theta\cdot(\cos\phi+\gamma'\sin\phi)$$

$$dy_\gamma=\sin\theta\cdot\sin(\phi+\gamma')=\sin\theta\cdot(\sin\phi-\gamma'\cos\phi)$$

$$dz_\gamma=\cos\theta.$$

15. The method of claim 14, wherein adjusting the beam pointing angle further comprises:

determining a predicted phase vector gradient (dx'), for a beam pointing vector V, along the X-axis, utilizing the BSPU, wherein $dx'=dx_\alpha+dx_\beta+dx_\gamma$, the beam pointing vector V representative of the beam point angle;

determining a predicted phase vector gradient (dy'), for the beam pointing vector V, along the Y-axis, utilizing the BSPU, wherein $dy'dy_\alpha+dy_\beta+dy_\gamma$;

determining a predicted phase vector gradient (dz'), for the beam pointing vector V, along the Z-axis, utilizing the BSPU, wherein $dz'dz_\alpha+dz_\beta dz_\gamma$; and steering the PAA, based on the predicted phase vector gradients dx', dy' and dz' to compensate for the predicted change in at least one of the geolocation and the orientation of the PAA.

16. A computer-readable medium for use in controlling pointing of an antenna mounted on a mobile platform, where the antenna moves independently of motion of the mobile platform, and where the mobile platform has a central navigation system, the computer-readable medium comprising:

encoded thereon instructions interpretable by a computer to instruct the computer to:

receive periodic measurements from a localized navigation subsystem disposed adjacent the antenna, and apart from the central navigation system, to move in accordance with movement of the antenna, where said measurements are representative of movement of the antenna over a first specified period of time (t), wherein to instruct the computer to receive periodic measurements representative of movement of the antenna over a first specified period of time (t), the computer-readable medium having encoded thereon instructions configured to instruct the computer to:

receive an angular rotation measurement (α) a predetermined number of times (n) within the first time period t, each angular rotation measurement (α) representative of a change in movement of the antenna about the X-axis;

receive an angular rotation measurement (β) the predetermined number of times n within the first time period t, each angular rotation measurement (β) representative of a change in movement of the antenna about the Y-axis; and receive an angular rotation measurement (γ) the predetermined number of times n within the first time period t, each angular rotation measurement (γ) representative of a change In movement of the antenna about the Z-axis;

predict an amount of movement of the antenna within a second specified time period (T) utilizing the predetermined number of angular rotation measurements (α), (β) and (γ); and adjust a beam pointing direction of the antenna to compensate for the predicted amount of movement.

17. The computer-readable of claim 16, wherein to instruct the computer predict an amount of movement of the antenna within the second specified time period T, the computer-readable medium has encoded thereon instructions configured to instruct the computer to:

determine a direction of rotation for each of the angular rotations α, β and γ; and determine an average amount of angular rotation ($\Delta V_\alpha$), an average amount of angular rotation ($\Delta V_\beta$) and an average amount of angular rotation ($\Delta V_\gamma$) of the antenna about the X, Y and Z axes for the first time period t ,in accordance with the following equations:

$\Delta V_\alpha=[(V_{\alpha 1}+V_{\alpha 2}+\ldots V_{\alpha n})/n]-V_{\alpha null}$, wherein $V_{\alpha null}$ is the value of the vector $V$ along the X-axis at the initial beam pointing angle $\Delta V_\beta=[(V_{\beta 1}+V_{\beta 2}+\ldots V_{\beta n})/n]-V_{\beta null}$, and wherein $V_{\beta null}$ is the value of the vector $V$ along the Y-axis at the initial beam pointing angle; and $\Delta V_\gamma=[(V_{\gamma 1}+V_{\gamma 2}+\ldots V_{\gamma n})/n]-V_{\gamma null}$, and wherein $V_{\gamma null}$ is the value of the vector $V$ along the Z-axis at the initial beam pointing angle.

18. The computer-readable of claim 17, wherein to instruct the computer to predict an amount of movement of the antenna within the second specified time period T, the computer-readable medium has encoded thereon instructions configured to instruct the computer to:

determine a predicted amount of angular rotation α', a predicted amount of angular rotation β' and a predicted amount of angular rotation γ' of the antenna about the X, Y and Z axes for the time period T, in accordance with the following equations:

$\alpha'=\Delta V_\alpha * T$;

$\beta'=\Delta V_\beta * T$; and $\gamma'=\Delta V_\gamma * T$, wherein $T$ is a function of $t$;

convert the predicted angular rotation α' to radians ($dx_\alpha$, $dy_\alpha$ and $dz_\alpha$);

convert the predicted angular rotation β' to radians ($dx_\beta$, $dy_\beta$ and $dz_\beta$); and convert the predicted angular rotation γ' to radians ($dx_\gamma$, $dv_\gamma$ and $dz_\gamma$).

19. The computer-readable of claim 18, wherein to instruct the computer to predict an amount of movement of the antenna within the second specified time period T, the computer-readable medium has encoded thereon instructions configured to instruct the computer to:

determine a predicted amount of movement of the antenna along the X, Y and Z axes at the time T, as a result the angular rotation αin accordance with the following equations:

if the direction of the predicted angular rotation α' is counter-clockwise, then $dx_\alpha=\sin(\theta+\alpha')\cdot\cos\phi=(\sin\theta+\alpha'\cos\theta)\cdot\cos\phi$ $dy_\alpha=\sin(\theta+\alpha')\cdot\sin\phi=(\sin\theta+\alpha'\cos\theta)\cdot\sin\phi$ $dz_\alpha=\cos(\theta+\alpha')=\cos\theta-\alpha'\sin\theta$; and if the direction of the predicted angular rotation α' is clockwise, then $dx_\alpha=\sin(\theta+\alpha')\cdot\cos\phi=(\sin\theta+\alpha'\cos\theta)\cdot\cos\phi$ $dy_\alpha=\sin(\theta+\alpha')\cdot\sin\phi=(\sin\theta+\alpha'\cos\theta)\cdot\sin\phi$ $dz_\alpha=\cos(\theta+\alpha')=\cos\theta-\alpha'\sin\theta$;

determine a predicted amount of movement of the antenna along the X, Y and Z axes at the time T, as a result the angular rotation β in accordance with the following equations:

if the direction of the predicted angular rotation β' is counter-clockwise, then $dx_\beta=\sin(\theta+\beta')\cdot\cos\phi=(\sin\theta+\beta'\cos\theta)\cdot\cos\phi$ $dy_\beta=\sin(\theta+\beta')\cdot\sin\phi=(\sin\theta+\beta'\cos\theta)\cdot\sin\phi$ $dz_\beta=\cos(\theta+\beta')=\cos\theta-\beta'\sin\theta$; and if the direction of the predicted angular rotation β' is clockwise, then $dx_\beta=\sin(\theta+\beta')\cdot\cos\phi=(\sin\theta+\beta'\cos\theta)\cdot\cos\phi$ $$dy_\beta=\sin(\theta+\beta')\cdot\sin\phi=(\sin\theta+\beta'\cos\theta)\cdot\sin\phi$$

$$dz_\beta=\cos(\theta-\beta')=\cos\theta+\beta'\sin\theta;\text{ and}$$

determine a predicted amount of movement of the antenna along the X, Y and Z axes at the time T, as a result the angular rotation γ in accordance with the following equations:

if the direction of the predicted angular rotation γ' is counter-clockwise, then $$dx_\gamma=\sin\theta\cdot\cos(\phi+\gamma')=\sin\theta\cdot(\cos\phi-\gamma'\sin\phi)$$

$$dy_\gamma=\sin\theta\cdot\sin(\phi+\gamma')=\sin\theta\cdot(\sin\phi+\gamma'\cos\phi)$$

$$dz_\gamma=\cos\theta;\text{ and}$$

if the direction of the predicted angular rotation γ' is counter-clockwise, then $$dx_\gamma=\sin\theta\cdot\cos(\phi+\gamma')=\sin\theta\cdot(\cos\phi-\gamma'\sin\phi)$$

$$dy_\gamma=\sin\theta\cdot\sin(\phi+\gamma')=\sin\theta\cdot(\sin\phi+\gamma'\cos\phi)$$

$$dz_\gamma=\cos\theta.$$

20. The computer-readable of claim 19, wherein to instruct the computer to predict an amount of movement of the antenna within the second specified time period T, the computer-readable medium has encoded thereon instructions configured to instruct the computer to:

determine a predicted vector gradient (dx') for the beam pointing vector V along the X-axis, a predicted vector gradient (dy') for the beam pointing vector V along the Y-axis, and a predicted vector gradient (dz') for the beam pointing vector V along the Z axis, in accordance with the following equations:

$$dx'=dx_\alpha+dx_\beta+dx_\gamma;$$

$$dy'=dy_\alpha+dy_\beta+dy_\gamma;\text{ and}$$

$$dz'=dz_\alpha+dz_\beta+dz_\gamma;\text{ and}$$

steer the antenna based on the predicted phase vector gradients dx', dy' and dz' to compensate for the predicted amount of movement of the antenna.

* * * * *